United States Patent [19]

Freissmuth et al.

[11] 4,154,606

[45] May 15, 1979

[54] COMPOSITION AND METHOD FOR THE DESULFURIZATION OF MOLTEN IRON

[75] Inventors: Alfred Freissmuth, Trostberg; Werner Gmöhling, Hufschlag; Walter Meichsner, Krefeld; Heinrich Röck, Trostberg, all of Fed. Rep. of Germany

[73] Assignee: Süddeutsche Kalkstickstoff-Werke Aktiengesellschaft, Trostberg, Fed. Rep. of Germany

[21] Appl. No.: 881,993

[22] Filed: Feb. 28, 1978

[30] Foreign Application Priority Data

Mar. 2, 1977 [DE] Fed. Rep. of Germany ..... 2709062

[51] Int. Cl.[2] ..... C21C 7/02

[52] U.S. Cl. ..... 75/58; 75/53

[58] Field of Search ..... 75/53–58

[56] References Cited

U.S. PATENT DOCUMENTS

| | | | |
|---|---|---|---|
| 4,067,729 | 1/1978 | Holzgruber | 75/58 |
| 4,078,915 | 3/1978 | Meichsner | 75/58 |

*Primary Examiner*—P. D. Rosenberg

*Attorney, Agent, or Firm*—Sprung, Felfe, Horn, Lynch & Kramer

[57] ABSTRACT

Finely granular desulfurizing agents for iron melts, consisting of at least one alkaline earth metal carbonate and at least one reducing metal carbide and optionally a reducing metal or an alloy thereof, are outstandingly effective in desulfurizing action and, based on the high degree of utilization of said agent, increase the amount of slag formed only to a negligible degree.

12 Claims, No Drawings

COMPOSITION AND METHOD FOR THE DESULFURIZATION OF MOLTEN IRON

The invention relates to a finely granular desulfurizing agent suitable for molten pig iron and steel, which is based on carbonate and carbide, and to a method for the desulfurization of iron melts.

The desulfurization of pig iron and steel is gaining importance on account of the deteriorating quality of the ores and the increasing use of high-sulfur coke and heavy furnace oil. The high-quality iron and steel needed today can be produced only by desulfurization in the blast furnace or between the blast furnace and the steel mill, or by desulfurization after the steelmaking process.

Alkaline earth oxides, such as lime, and alkaline earth carbonates, such as limestone or dolomite, have long been known as desulfurization agents for molten iron.

A great number of molten iron desulfurizing agents consist of alkaline earth oxides to which other substances are added. For example, processes have become known in which finely ground lime is blown with natural gas into pig iron, the natural gas being cracked endothermically to carbon and hydrogen. In another process, lime dust is mixed with powdered magnesium and this mixture is blown through a lance into the molten pig iron. The desulfurization is caused by the magnesium vaporizing with the absorption of heat. Mixtures of lime or calcium carbonate and soda are frequently recommended for the desulfurization of pig iron. However, such compositions, although very inexpensive, are rarely used nowadays, for environmental reasons, and on account of the corrosive effect they have on the lining of ladles as well as the temperature drop they cause in the melt.

The thermal dissociation of the alkaline earth carbonates, which occur when they are injected into the molten iron, releases large amounts of gas which violently agitates the bath and can cause molten metal to be splashed out. On account of this disadvantage of the uncontrollable formation of gas, the inexpensive and environmentally safe alkaline earth carbonates have not been used for the injection method of desulfurizing molten iron. The thermal dissociation of the alkaline earth carbonates is an endothermal reaction which cools the molten iron, as shown by the following equations:

$$CaCO_3 \rightarrow CaO + CO_2 \quad H = +42.8 \text{ kcal/mole}$$

$$MgCO_3 \rightarrow MgO + CO_2 \quad H = +24.3 \text{ kcal/mole.}$$

If it is desired to make better use of these reactions, the formation of gas—that is, the splitting off of carbon dioxide in the thermal dissociation of the alkaline earth carbonates—must be suppressed.

The alkaline earth oxides produced from alkaline earth carbonates by present-day calcination methods are slow to react on account of the long time they spend in the kiln. Even in the case of low calcination, which is performed at the lowest possible temperature, the alkaline earth oxide is exposed to the calcination temperature for at least 20 minutes. In the calcination process, the finely crystalline active alkaline earth oxide, which is primarily formed from the alkaline earth carbonate by thermal dissociation, rapidly recrystallizes under the kiln conditions to a coarse oxide which is relatively inactive with respect to the sulfur dissolved in molten iron.

Technical calcium carbide, with and without additives, has already been proposed as a desulfurizing agent. In recent years there has been an interest especially in molten iron desulfurizing agents based on calcium carbide, to which precipitated or finely ground calcium carbonate, diamide lime (a mixture of finely crystalline calcium carbonate and carbon), water or hydrogen yielding compound, such as borates, alkaline earth hydroxide, hydrocarbons such as polyethylene, polypropylene, polyesters, tar, heavy oil and other substances, have been added. These additives intensify the movement and circulation of iron melts by yielding gas when the finely granular desulfurizing agent is added, thereby producing a good contact between the actual desulfurizing agent, that is, the calcium carbide, and the molten iron. At the same time, the yielding of gas and the oxidation of the carbon to carbon monoxide, or the yielding of hydrogen, was supposed to create a reducing atmosphere whereby the oxidation of the calcium carbide acting as a desulfurizing agent by the carbon dioxide forming from the carbonates would be prevented. The carbon dioxide was supposed to be reduced to carbon monoxide by the carbon and/or hydrocarbon of the desulfurizing agent.

These more recent desulfurizing agents, however, still have disadvantages. Particularly the relatively low yield of the desulfurization reaction taking place in accordance with Equation 1—with respect to the calcium carbide put in—called for more careful investigation of the processes taking place during the reaction.

$$CaC_2 + S \rightarrow CaS + 2C \qquad (1)$$

The low yield was all the more surprising inasmuch as, towards the end of the treatment, calcium carbide could no longer be detected in the slag.

The invention, therefore, is addressed to the problem of finding a more effective desulfurization mixture which, based on easily available starting products, and with a high rate of reaction, would assure a very high degree of utilization of the desulfurizing agent put in, thereby increasing the amount of slag to only a negligible degree.

This problem has been solved by a finely granular desulfurizing agent for iron melts based on carbonate and carbide, which is characterized in that it contains no additional carbon, and consists of at least one alkaline earth carbonate and at least one reducing metal carbide, as well as, in some cases, a reducing metal or an alloy thereof.

It has been found that alkaline earth carbonates react exothermically with metal carbide beginning at approximately 1100° C. It is surprising that in this reaction a large amount of carbon forms and hardly any formation of gas occurs. An explanation is offered by a reaction in accordance with Equation 4. This assumption gains further support from the fact that calcium carbide reacts very exothermically at the said temperatures also in accordance with Equation 3, with the release of carbon and the formation of calcium oxide.

When alkaline earth carbonates are blown into iron melts, the time of stay of the alkaline earth oxide formed from the carbonates and of the carbon dioxide formed by thermal dissociation is only a few seconds, even when the lance is immersed to a depth of two to four meters. The carbon dioxide that develops is captured in an exothermic reaction by the addition, in accordance with the invention, of a reducing carbide; the gas bubble that develops immediately collapses, and the superheated oxide that forms produces the desulfurization together with the oxide formed from the alkaline earth carbonate. The formation and the collapse of the gas bubbles promotes the movement and mixing of the iron melt.

The very small, highly active oxide crystallites formed from the alkaline earth carbonate in situ react, in the time of their ascent, with the sulfur dissolved in the molten iron, with a considerably higher degree of transformation than normal technically burnt lime, since in this short period no recrystallization and grain growth takes place whatever.

Alkaline earth carbonates, therefore, react exothermically with carbidic reducing agents when blown into iron melts of temperatures between about 1200° and 1700° C., with the formation of highly active alkaline earth oxide. In the case of calcium carbonate and calcium carbide, the reaction equations are as follows:

$$CaCO_3 \rightarrow CaO + CO_2 H_2 = +43 \text{ kcal/mole} \quad (2)$$

$$CO_2 + 2CaC_2 \rightarrow 2CaO + 5C \; H_3 = -181 \text{ kcal/mole} \quad (3)$$

$$CaCO_3 + 2CaC_2 \rightarrow 3CaO + 5C \; H4 + -138 \text{ kcal/mole} \quad (4)$$

According to the gross reaction of Equation 4, the agent composed of calcium carbonate and calcium carbide or the calcium oxide formed therefrom, which is blown into the iron melt, superheats to several hundreds of degrees Celsius above the iron temperature. The same applies accordingly to the other alkaline earth metals and lithium.

The highly active alkaline earth oxide formed in situ has an outstanding desulfurizing action in accordance with Equations 5 and 5a.

$$CaO + [S] + C \rightarrow CaS + CO \quad (5)$$

$$MgO + [S] + C \rightarrow MgS + CO \quad (5a)$$

The formation of gas as a result of the splitting of carbon dioxide out of the alkaline earth carbonate will then take place in an only intermediate manner. The carbon dioxide is reduced to carbon by the reducing carbide, such as calcium carbide for example, active alkaline earth oxide, superheated on account of the great exothermy of this reaction, forming additionally, which has an outstanding desulfurizing action. The carbon monoxide formed in accordance with Equation 5 is exothermically reduced to carbon, reactive calcium oxide again forming from calcium carbide for example (Equation 6).

$$CO + CaC_2 \rightarrow CaO + 3C \; \Delta H = -106 \text{ kcal/mole} \quad (6)$$

In the agent of the invention, therefore, the alkaline earth carbonate acts as the actual desulfurizing agent after the corresponding oxide has been formed, while the carbide, by reacting with the carbonate, suppresses the undesirable gassing and is transformed into the oxide which also has a desulfurizing action.

Suitable alkaline earth carbonates are all naturally occurring carbonates, especially calcium carbonate and dolomite; also suitable are half-burned dolomite, magnesite, strontium carbonate and barium carbonate, and the alkaline earth carbonates which are produced in technical reactions, nical reactions, as by-products for example, such as the calcium carbonate formed in the washing of carbon dioxide. Lithium carbonate is likewise suitable.

In the case of a mixture of magnesium carbonate and calcium carbide, the processes which take place when it is blown into an iron melt are described by the following equations:

$$MgCO_3 \rightarrow MgO + CO_2 \; \Delta H = +24.3 \text{ kcal/mole} \quad (7)$$

$$CO_2 + 2CaC_2 \rightarrow 2CaO + 5C \; \Delta H = -181 \text{ kcal/mole} \quad (8)$$

$$MgCO_3 + 2CaC_2 \rightarrow 2CaO + MgO + 5C \; \Delta H = -157 \text{ kcal/mole} \quad (9)$$

The desulfurizing agent composed of magnesium carbonate and calcium carbide in accordance with Equation 9 is even more exothermic than the agent composed of calcium carbonate and calcium carbide in accordance with Equation 4. The finely divided, highly active, superheated magnesium oxide that forms according to Equation 9 is a substance which has an outstanding desulfurizing action.

Calcium carbide, barium carbide, aluminum carbide, magnesium carbide, lithium carbide, boron carbide, titanium carbide and other carbides are suitable reducing carbides. Mixtures of the reducing carbides can also be used.

The surface area of the active alkaline earth oxide formed in situ is substantially larger than that of the alkaline earth carbonate injected into the molten iron, and also larger than that of the reducing carbide. The high activity of the alkaline earth oxide is explained by this large surface that is available for the desulfurizing reaction. The particle size of the alkaline earth oxides approaches that of pyrogenically produced dusts. The surface area of such dusts exceeds by several orders of magnitude the surface enlargement that can be achieved by the grinding of solids.

The composition of the desulfurizing agent of the invention can vary within wide limits. The alkaline earth carbonate content will amount preferably to from 85 to 5% by weight, and the reducing carbide content to 15 to 95% by weight. For use in steel melts, the percentages of the carbonate will be in the lower range. Agents are preferred for this purpose which have a content of from 3 to 50% by weight, and especially preferred are those containing from 10 to 40% alkaline earth carbonate by weight. To control the physical properties of the slags and to enhance the reducing activity of the desulfurizing agent, the latter can additionally contain reducing metals, such as magnesium, aluminum, calcium or other alloys such as calcium silicon, for example, in amounts up to 10% by weight.

The desulfurizing agents of the invention are incorporated pneumatically into the pig iron or steel melts in a known manner, e.g., by means of a submersible lance. In the brief period of the ascent of the desulfurizing agent, the exothermic formation of the highly active alkaline earth oxide takes place, with reduction of the intermediately released carbon dioxide to carbon. The intermediate gas formation is important for the distribution of the desulfurizing agent in the melt and for the stirring of the melt.

The components of the agent of the invention can be added separately or in mixture. If separately, the components can be conveyed pneumatically separately and combined either just ahead of or within the lance to form the mixture.

Through the use of different metals in the carbide and of lithium carbonate or of different metals in the alkaline earth carbonate, the melting points of the resulting oxides or oxide mixtures can be controlled, thereby also permitting control of the melting point or of the sintering action of the slags floating on the molten iron. The desulfurizing agents on the basis of alkaline earth carbonate and carbide yield, when the reaction is complete, the following oxides and oxide mixtures, for example:

| Equation No. | Desulfurizing Mixture | Oxide or Oxide Mixture |
|---|---|---|
| (4) | $CaCO_3 + 2CaC_2$ | 3CaO |
| (9) | $MgCO_3 + 2CaC_2$ | MgO + 2CaO |
| (10) | $\frac{1}{2}CaMg(CO_3)_2 + 2CaC_2$ | $\frac{1}{2}MgO + 2\frac{1}{2}$ CaO |

The components of the desulfurizing agent must be thoroughly ground up. The grain size of the alkaline earth carbonate can be larger than that of the carbide. The carbide must be as fine as possible so as to offer the greatest possible surface area to the intermediately forming carbon dioxide for the reaction. This reaction is ultimately a "burning" of the carbide in the momentarily present carbon dioxide and/or carbon monoxide.

The exothermic desulfurizing agent of the invention has the advantage that it can be injected easily, by means of the blowing techniques commonly in use today, into the iron melts contained in the hearth of the blast furnace, in open ladles or torpedo ladles or mixers. In this case, the alkaline earth carbonate and the carbide react with one another either through intermediately formed carbon dioxide or, if both substances are very finely ground and have large surface areas, directly.

It is advantageous for the reaction of the carbon dioxide with the carbide if the desulfurization mixture is injected through the blowing lance as deeply as possible into the iron melt. Immersion depths of about 1 to 3 meters correspond to excess pressures of about 0.72 to 2.16 bars.

An additional overpressure of the gas atmosphere on the molten iron has an advantageous effect accordingly. The higher concentration of the carbon dioxide in the gas phase has an accelerating effect on the reaction with the carbide and reduces the risk of the separation of gas and solid matter.

EXAMPLE 1

Desulfurization of a molten steel with a mixture of calcium carbonate, calcium carbide and a small content of aluminum.

A series of melts of what are called carbon steels of the following analysis:

0.31 wt.-% carbon
0.31 wt.-% silicon
0.55 wt.-% manganese, and a starting sulfur content $S_A$ of 0.017 to 0.031 wt.-%, at a temperature of 1600° C., are to be reduced by the desulfurizing treatment to an average final sulfur content $S_E$ of 0.004 wt.-%.

To limit the oxidizing effect on the steel bath, the desulfurizing mixture contains a slight deficiency of calcium carbonate in relation to the calcium carbide. The small aluminum content is intended to assure the required aluminum content in the steel and to produce a refining action through the formation of $CaO.Al_2O_3$.

In conjunction with a slag cover that was low in oxides and contained fluorspar, a desulfurization mixture consisting of 32 wt.-% of calcium carbonate
65 wt.-% of calcium carbide and
3 wt.-% of aluminum was pneumatically injected into the molten steel contained in a 70 metric ton ladle. Six to ten liters of argon per kilogram of desulfurizing mixture were used as the carrier gas.

The following table shows the result of the individual treatments.

| Treatment No. | $S_A$ | $S_E$ | ΔS | Consumption kg/t | α |
|---|---|---|---|---|---|
| 1 | 0.031 | 0.004 | 0.027 | 2.2 | 0.74 |
| 2 | 0.034 | 0.004 | 0.030 | 2.3 | 0.76 |
| 3 | 0.034 | 0.002 | 0.032 | 3.0 | 0.93 |
| 4 | 0.017 | 0.003 | 0.014 | 1.7 | 1.20 |
| 5 | 0.024 | 0.003 | 0.021 | 2.0 | 0.95 |
| 6 | 0.026 | 0.005 | 0.021 | 1.8 | 0.86 |

The consumption of an average of 2.1 kg of desulfurizing mixture per metric ton of steel is substantially lower when compared with the desulfurizing mixtures known heretofore.

The alpha value is characteristic of the specific consumption of desulfurizing mixture in kg per metric ton of iron for each 0.01% of the decrease in the sulfur content.

EXAMPLE 2

Desulfurization of pig iron with a mixture consisting of dolomite, calcium carbide and aluminum.

160 metric tons of pig iron at a temperature of 1330° to 1336° C. were treated in an open ladle with a mixture consisting of 60 wt.-% dolomite, 35 wt.-% calcium carbide and 5 wt.-% aluminum. For each kilogram of desulfurizing agent, 6 to 10 liters of nitrogen were used for the injection of the mixture into the molten pig iron.

| Treatment No. | $S_A$ | $S_E$ | S | Desulf. Mix. consumption in kg/t | |
|---|---|---|---|---|---|
| 1 | 0.047 | 0.014 | 0.033 | 3.1 | 0.93 |
| 2 | 0.054 | 0.015 | 0.039 | 3.3 | 0.85 |
| 3 | 0.039 | 0.007 | 0.032 | 3.0 | 0.93 |
| 4 | 0.062 | 0.016 | 0.046 | 3.8 | 0.83 |
| 5 | 0.046 | 0.006 | 0.040 | 3.4 | 0.85 |
| 6 | 0.051 | 0.004 | 0.047 | 4.4 | 0.93 |
| 7 | 0.044 | 0.004 | 0.040 | 3.5 | 0.88 |
| 8 | 0.071 | 0.013 | 0.058 | 4.9 | 0.84 |
| 9 | 0.027 | 0.002 | 0.025 | 3.0 | 1.20 |

The expenditure of an average of 3.6 kg of desulfurizing mixture is 30 to 40% lower than in the case of the desulfurizing agents used heretofore.

EXAMPLE 3

Desulfurization of a steel melt with a mixture of calcium carbonate, calcium carbide and aluminum.

A series of steel melts, commonly called soft steels, of the following analysis:

0.03 wt.-% carbon
0.20 wt-% silicon
0.30 wt.-% manganese, and a starting sulfur content $S_A$ of 0.012 to 0.026 wt.-%, are to be reduced to an average final sulfur content $S_E$ of 0.03 wt.-% by the desulfurization treatment.

The steel bath was covered with a low-oxide slag containing flux. The desulfurizing agent had the following composition:

35 wt.-% calcium carbonate
59 wt.-$ calcium carbide
6 wt.-% aluminum, and it was blown by an argon stream of 6 to 10 liters per minute into an open ladle containing 90 metric tons of steel.

The following table gives the results of the individual treatments:

| Treatment No. | $S_A$ | $S_E$ | S | Consumption kg/t | |
|---|---|---|---|---|---|
| 1 | 0.021 | 0.004 | 0.017 | 1.7 | 1.0 |
| 2 | 0.026 | 0.003 | 0.023 | 1.9 | 0.83 |
| 3 | 0.013 | 0.003 | 0.010 | 1.0 | 1.0 |
| 4 | 0.017 | 0.005 | 0.012 | 1.2 | 1.0 |
| 5 | 0.019 | 0.002 | 0.017 | 2.1 | 1.2 |
| 6 | 0.025 | 0.003 | 0.022 | 2.0 | 0.9 |

The consumption averaging 1.6 kg of desulfurizing mixture per metric ton of steel is approximately 25 to 35 percent lower in comparison to previously known desulfurization mixtures.

We claim:

1. Finely granular desulfurizing agent for iron melts, comprising at least one alkaline earth carbonate, at least one reducing metal carbide, and a reducing metal or alloy thereof, and containing no additional carbon other than in carbonate or carbide form.

2. Desulfurizing agent as claimed in claim 1, containing at least one carbide selected from carbide, calcium carbide, barium carbide, magnesium carbide, aluminum carbide, titanium carbide, boron carbide and lithium carbide.

3. Desulfurizing agent as claimed in claim 1 wherein said alkaline earth metal carbonate is at one of calcium carbonate, magnesium carbonate, dolomite and barium carbonate.

4. Desulfurizing agent as claimed in claim 1 wherein said reducing metal is selected from the group consisting of aluminum, magnesium and cerium.

5. Desulfurizing agent as claimed in claim 1 wherein said alkaline earth metal carbonate constitutes from 5 to 85 weight-percent and the reducing carbide 95 to 15 weight-percent of said agent, the remainder being said reducing metal or alloy thereof.

6. Desulfurizing agent as claimed in claim 1 wherein the alkaline earth metal carbonate constitutes from 10 to 40 weight-percent of the agent, said reducing carbide constitutes 90 to 60 weight percent of the composition and aluminum constitutes from 1 to 7 weight-percent of the agent.

7. Process for the desulfurization of iron melts, comprising introducing into the melt a finely granular desulfurizing agent as claimed in claim 1.

8. Process as claimed in claim 7 wherein said reducing metal or alloy thereof is a reducing metal.

9. Process as claimed in claim 7 wherein said agent is introduced pneumatically with a lance.

10. Process as claimed in claim 7 wherein the carbonate and carbide are proportioned separately and are conveyed pneumatically to a lance, and combined just prior to entry into, or within, said lance, and are thereafter introduced to the iron melt.

11. Process as claimed in claim 8 wherein the introduction is performed by means of an inert gas.

12. Process as claimed in claim 7 wherein the desulfurizing agent is brought into the melt, while an excess of pressure exists in the atmosphere over the iron melt.

* * * * *